United States Patent [19]

Lopata

[11] 4,322,155

[45] Mar. 30, 1982

[54] ELECTROSTATIC DISPLAY APPARATUS

[75] Inventor: Ira Lopata, New York, N.Y.

[73] Assignee: Ragen Precision Industries, Inc., North Arlington, N.J.

[21] Appl. No.: 105,944

[22] Filed: Dec. 20, 1979

Related U.S. Application Data

[63] Continuation of Ser. No. 899,561, Apr. 24, 1978.

[51] Int. Cl.[3] ..... G03G 15/00

[52] U.S. Cl. ..... 355/3 R; 346/161; 355/5; 355/16

[58] Field of Search ..... 355/3 R, 16, 5, 12, 355/13, 20; 427/22; 346/161, 110 R; 430/31

[56] References Cited

U.S. PATENT DOCUMENTS

| | | | |
|---|---|---|---|
| 2,777,745 | 1/1957 | McNaney | 346/110 R |
| 3,819,262 | 6/1974 | Estandarte | 355/15 |
| 3,951,538 | 4/1976 | Bar-on | 355/3 FU |
| 3,973,846 | 8/1976 | Sullivan et al. | 355/16 |
| 4,136,943 | 1/1979 | Koizumi | 355/16 X |

*Primary Examiner*—R. L. Moses

*Attorney, Agent, or Firm*—Daniel H. Bobis

[57] ABSTRACT

An electrostatic display, recall or print apparatus in which a latent electrostatic pattern or image is formed on a dielectric strip; the image is toned (made visible by dusting with an electrostatic powder) and is advanced to a display station where it is viewed; if the image is acceptable, the strip is advanced to a fusing station and made permanent; if the image is not acceptable, the strip is withdrawn, the electrostatic image is neutralized and the toner is removed.

2 Claims, 1 Drawing Figure

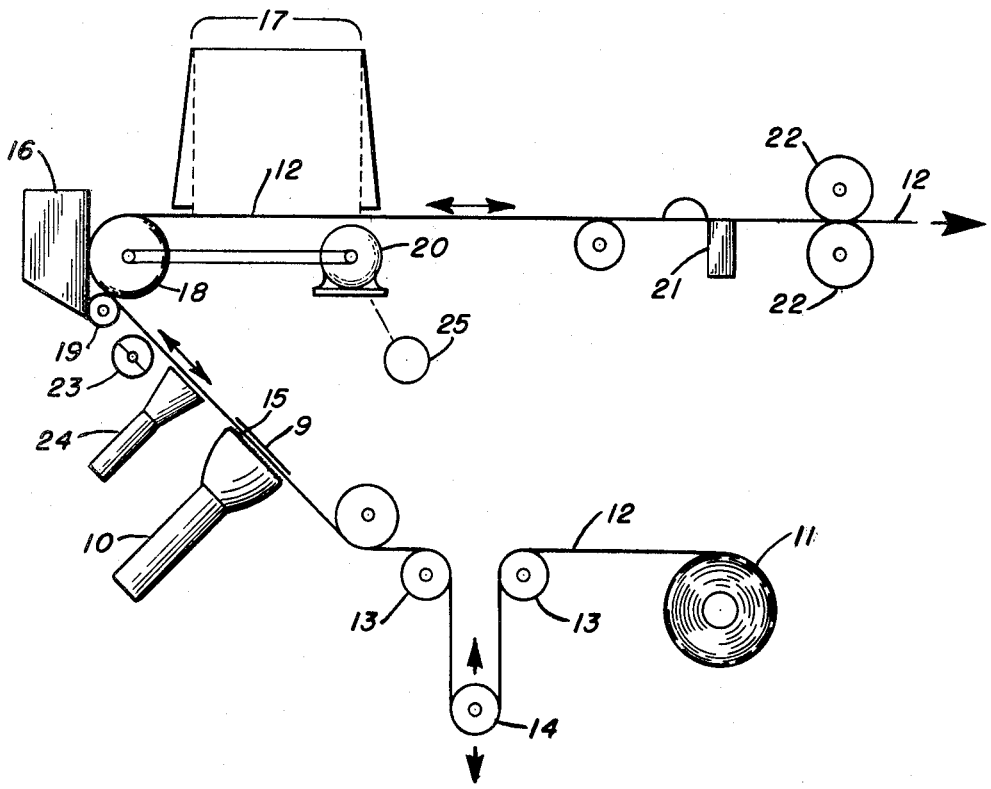
17
16
12
22
12
20
18
21
22
25
19
23
15
9
24
10
12
11
13
13
14

ELECTROSTATIC DISPLAY APPARATUS

CROSS-REFERENCE TO RELATED APPLICATION

This application is a continuation of application U.S. Ser. No. 899,561 filed Apr. 24, 1978 and comprises the identical invention described in the specification therein. The benefit of the filing date of that prior application is claimed; only the claims herein set forth are different but relate to the subject matter as originally disclosed.

BACKGROUND OF THE INVENTION

1. Field of Invention

This invention relates generally to electrostatic display apparatus, and particularly to electrostatic display apparatus in which the latent image may be viewed between a toning station and a fusing station before it is fused; and then either advanced to be fused, or erased by neutralizing it and removing the toner, as the strip upon which it was formed is withdrawn.

2. Prior Art

Electrostatic display systems are in wide, general use in multi-branch banks, multi-branch manufacturing operations, criminal identification systems, and numerous other types of usage. In such systems, there is usually a central pool of available stored information that is subject to being recalled and displayed at a terminal. Where numerous bits of information are stored, the information is usually presented on the face of a cathode-ray tube where it may be read. Such terminals may be very costly. The display usually takes the form of a greenish image on a dark background. If such images are to be read continuously, they become extremely fatiguing to the eye. On the other hand if the information is used in a xerographic display system, the terminal does not provide means for viewing the information until after it is permanently imprinted on a dielectric strip and fused thereon. If the information applied to the strip does not include the desired bits of information, the permanent print is useless and must be discarded.

No apparatus is now known or available where a temporary visible electrostatic image is formed on a strip and is viewable in its preformed state, subject to being rejected and the strip reused if the temporary visible electrostatic image is not acceptable.

SUMMARY OF THE INVENTION

It has been found that instead of the information being displayed either as a greenish, glowing image, or alternatively as a permanent electrostatic image, which may have to be discarded because it does not contain the desired information, a latent electrostatic image can be formed on a dielectric strip and toned for viewing and evaluation at a generally horizontal viewing station disposed between the toning station and the fusing station. If the image contains the desired bits of information required, it may be fused and made permanent. On the other hand if the desired bits of information are not on the toned electrostatic image, the image may be neutralized and the toner removed by withdrawing the strip from the viewing station, neutralizing the electrostatic charge, and vacuuming off or otherwise removing the toner. Thus in lieu of reading the eye-taxing greenish cathode-ray image, the temporary electrostatic, unfused image toned on the dielectric strip can be coveniently viewed as a black and white printed image on paper, and can be easily read. If the image is rejected, the strip is reversed and withdrawn, the image is neutralized or discharged, and a vacuum scoop collects the electrostatic toner from the paper. Thus the present device accomplishes the production of a temporary image that can be viewed and if desired can be made permanent, or can be neutralized and removed from the strip. By reason of this device, the toning station is spaced away from the fusing station a distance sufficient to enable the toned image to be viewed and inspected. The strip is fed by a reversible feed motor. If the unfused image as viewed between the toning station and the fusing station is found to be unacceptable for any reason, the feed motor is reversed to recall the strip for removal of the unfused image; but if the image is acceptable, the motor is not reversed but energized to feed the strip to the fusing station.

DRAWING

These objects and advantages as well as other objects and advantages may be achieved by the device shown by way of illustration in the drawing in which:

The FIGURE shows a schematic view of the apparatus for producing the temporary electrostatic display, for viewing the display, recalling and erasing the display, or permanently printing the display by fusing it.

PREFERRED EMBODIMENT

Referring now to the drawing in detail, there is provided a supply roll 11 containing a dielectric strip 12. Electrostatic papers suitable for use as the strip 12 are well known. Such papers have a dielectric coating which should be a good insulation of uniform thickness on the paper, and the underlying base should be conductive. The paper fibers must be treated to increase conductivity. The paper stock is treated with ionic materials or humectants and in this way, it becomes conductive and receptive to the electrostatic charge to form the latent image. Such coatings may be a vinylchloride - vinylacetate copolymer, and many other ionic materials are well known. Other materials beside paper may be used. The strip 12 is then led over a pair of idlers 13 and kept apart between them by a dancer or take up roller 14. The roller 14 constitutes a mean to take up the strip 12 back when a reverse feed motor is operated as will appear later.

The strip 12 is passed over a high resolution cathode-ray tube 10. The tube 10 has closely spaced metal fine wires 15 on its face plate. Any image on the face plate selectively charges the metal wires 15 and imparts a corresponding electrostatic charge pattern on the strip 12. The fine wires are embedded in the face of the tube and are all insulated from each other. As the electron beam in the c.r. tube sweeps across the ends of the wires 15 on the face of the tube, electrons on the wires are deposited onto the surface of the coated strip 12. The strip 12 is disposed in close relation to the wires 15 and is supported by a grounded electrode 9 to attract the electrostatic charge from the wires 15. Arcing is a possibility but is not necessary. The strip 12 next moves past a toner box 16 which embodies the usual cascade development procedure for charging latent electrostatic images on a strip. In this, a scoop conveyor (not shown) deposits powder in a cascade upon the strip 12 and the toner powder is attracted to and adheres only to the latent image, making it visible. Charges of polarity opposite to the polarity of the latent image charges on the strip 12 are induced on the toner powder, so that the powder displays an affinity for the latent pattern images on the strip.

The strip 12 then moves to and passes for inspection at a viewing station 17, being driven by a feed roller 18 engaged with an idler 19. A reversible motor 20 drives the feed roller 18. At the viewing station 17, if inspection of the strip 12 reveals that the toned electrostatic image displays information which is useful, the motor 20 feeds the strip and it is cut from the supply roll 11 by the knife 21 and passed through fusing rollers 22 where the image becomes permanently fused and bonded to the strip, whereupon the strip is ejected. However, if the image at the viewing station 17 does not contain the desired information, the switch 25 reverses the motor 20 and the strip 12 is withdrawn from the viewing station 17. It then moves past a discharge unit 23 of conventional design and a vacuum pick up device 24, neither of which are activated until the motor 20 is reversed. The discharge unit 23 electrostatically neutralizes the charge imparted to the strip 12 by the cathode-ray tube 10 and the vacuum pick up device 24 removes the toner from the strip 12, leaving it blank and untoned.

The cathode-ray tube 10 such as previously referred to as having metal fibers on its face, is well known in the electrostatic arts and may be obtained from Westinghouse Corporation, Litton Industries, Thomas Electronics of Wayne, New Jersey or many other suppliers.

By means of this apparatus, numerous terminals may be activated to display the same image simultaneously. The image can be easily read as black print upon a white background, and since it is only temporary and unfused, can be neutralized and rejected or can be fused and discharged from the apparatus.

By means of this apparatus, the unfused electrostatic image becomes a reference in cases where it is used for one-time information supplied to the viewer, who does not need to refer again to the information once he has read it. The strip 12 is recalled from the viewing station and may be used again. There is no accumulation of strips with a permanent fused image that may never have to be referred to again. Economy of strip 12 material is accomplished.

What is claimed is:

1. An apparatus for forming, toning and displaying the unfused visible electrostatic image on an electrostatic strip, and alternatively and selectively for erasing the electrostatic image to permit reuse of the electrostatic strip or for fusing the visible electrostatic image to make a permanent copy thereof includes, a. source means for said electrostatic strip, b. a generally horizontal planar surface means having a viewing station thereon disposed in spaced relation to the source means, said planar surface means having an inlet end and an outlet end for the electrostatic strip, c. means connected to the source means to normally feed the electrostatic strip in a forward direction through a predetermined course to and across the viewing station on said planar surface means to dispose the electrostatic strip for inspection at the viewing station and said feed means including, means for reversing the direction of movement of the electrostatic strip, d. means between the source means and the inlet side of the planar surface means and disposed relative the electrostatic strip to form a latent electrostatic image on the electrostatic strip, e. toning means between the latent electrostatic image forming means and the inlet side of the planar surface means to make the latent electrostatic image visible for inspection when the electrostatic strip is moved forward to the viewing station, f. means adjacent the outlet end of the planar surface selectively operable only on forward movement of the electrostatic strip to fuse the desired visible electrostatic image to form a permanent copy thereof, and g. a normally non-operative means disposed adjacent the inlet end of the planar surface means selectively operable when the reversing means is actuated to move the electrostatic strip in a reverse direction to neutralize and remove toner from the unfused visible electrostatic image to permit reuse of the electrostatic strip.

2. In an apparatus as claimed in claim 1 wherein the means to form the latent electrostatic image on the electrostatic strip includes;

a. cathode-ray tube means, b. a plurality of chargeable fibers on the face of the tube charged in accordance with a preselected pattern; and c. said chargeable fibers disposed for charging contact with the electrostatic strip.

* * * * *